US007768474B2

(12) United States Patent
Iwami

(10) Patent No.: US 7,768,474 B2
(45) Date of Patent: Aug. 3, 2010

(54) DEVICE FOR DRIVING CAPACITIVE LIGHT EMITTING ELEMENT

(75) Inventor: Takashi Iwami, Yamanashi-ken (JP)

(73) Assignee: Panasonic Corporation, Osaka (JP)

( * ) Notice: Subject to any disclaimer, the term of this patent is extended or adjusted under 35 U.S.C. 154(b) by 1215 days.

(21) Appl. No.: 10/962,514

(22) Filed: Oct. 13, 2004

(65) Prior Publication Data

US 2005/0088108 A1 Apr. 28, 2005

(30) Foreign Application Priority Data

Oct. 23, 2003 (JP) ..... 2003-362834

(51) Int. Cl.
*G09G 3/28* (2006.01)

(52) U.S. Cl. ..... 345/60; 345/212

(58) Field of Classification Search ..... 345/60, 345/61, 62, 63, 76, 82, 211, 79, 212; 315/169.1, 315/209

See application file for complete search history.

(56) References Cited

U.S. PATENT DOCUMENTS

| | | | | |
|---|---|---|---|---|
| 5,714,844 | A * | 2/1998 | Sato | 315/169.4 |
| 6,304,038 | B1 | 10/2001 | Ide et al. | 315/169.1 |
| 6,483,487 | B2 * | 11/2002 | Iseki | 345/60 |
| 6,686,912 | B1 * | 2/2004 | Kishi et al. | 345/211 |
| 7,227,514 | B2 * | 6/2007 | Lee | 345/60 |
| 2001/0017606 | A1 | 8/2001 | Choi | 345/60 |
| 2002/0047575 | A1 * | 4/2002 | Iwami | 315/169.3 |
| 2002/0063304 | A1 | 5/2002 | Toeda et al. | 257/507 |
| 2004/0217778 | A1 * | 11/2004 | Miyake | 326/83 |
| 2005/0035960 | A1 * | 2/2005 | Kobayashi | 345/212 |

FOREIGN PATENT DOCUMENTS

| | | |
|---|---|---|
| JP | 10-105113 | 4/1998 |
| JP | 2001-272939 | 10/2001 |
| JP | 2002-006803 | 1/2002 |
| JP | 2002-156941 | 5/2002 |
| JP | 2002-236468 | 8/2002 |
| JP | 2002-351394 | 12/2002 |
| JP | 2005-025153 | 1/2005 |

OTHER PUBLICATIONS

Khademsameni P. et al., "A tool for automated analog CMOS layout module generation and placement," Proceedings of the 2002 IEEE Canadian Conference, XP010707628, pp. 416-421.

* cited by examiner

*Primary Examiner*—Chanh Nguyen
*Assistant Examiner*—Pegeman Karimi
(74) *Attorney, Agent, or Firm*—Drinker Biddle & Reath LLP

(57) ABSTRACT

A driver device for a capacitive light emitting element includes a semiconductor integrated device and an electrical charge recovery circuit. The semiconductor integrated device includes a plurality of output buffers that supply a drive data-dependent voltage to each of a plurality of capacitive light emitting elements. The semiconductor integrated device also includes a plurality of switching elements that supply a high voltage to each of the output buffers. An external terminal of the semiconductor integrated device is commonly connected to respective nodes between the switching elements and output buffers. The electrical charge recovery circuit recovers electrical charge that has accumulated in the capacitive light emitting elements. The electrical charge recovery circuit is connected to the external terminal of the semiconductor integrated device.

16 Claims, 10 Drawing Sheets

DEVICE FOR DRIVING CAPACITIVE LIGHT EMITTING ELEMENT

BACKGROUND OF THE INVENTION

1. Field of the Invention

The present invention relates to a driver device for driving a capacitive light emitting element.

2. Description of the Related Art

At present, display panels composed of capacitive light emitting elements are called capacitive display panels and marketed as wall-mounted TVs. Typical wall-mounted TVs are plasma display panels (hereinafter called 'PDP') and electroluminescence display panels (hereinafter called 'ELDP').

FIG. 1 of the attached drawings shows part of a driver device that causes a capacitive display panel to emit light by applying a variety of drive pulses to the capacitive display panel. This driver device is disclosed in Japanese Patent Kokai (Laid-Open Application) No. 2002-156941.

As shown in FIG. 1, a PDP 10 includes a plurality of row electrodes (not shown) and a plurality of column electrodes $Z_1$ to $Z_m$ arranged to intersect one another. Discharge cells (not shown), which correspond with pixels, are formed the points of intersection between the row and column electrodes.

A column electrode driver circuit 20 includes a power supply circuit 21, which generates a resonance pulse supply voltage in accordance with switching signals SW1 to SW3, and a pixel data pulse generation circuit 22, which generates pixel data pulses that are to be applied to the column electrodes $Z_1$ to $Z_m$ on the basis of the resonance pulse supply voltage. The pixel data pulse generation circuit 22 includes switching elements $SWZ_1$ to $SWZ_m$ and $SWZ_{10}$ to $SWZ_{m0}$, which are each turned on and off individually in accordance with one display line's worth (m) of pixel data bits $DB_1$ to $DB_m$ that designate the state (lit or unlit) of the respective discharge cells. Each of the switching elements $SWZ_1$ to $SWZ_m$ is turned on (enters the ON state) when the pixel data bit DB supplied thereto is logic level 1, for example, and applies the resonance pulse supply voltage of the supply line 2 to the corresponding column electrode $Z_i$ ($Z_1$ to $Z_m$) On the other hand, when the pixel data bit DB is logic level 0, the switching element $SWZ_{i0}$ ($SWZ_{10}$ to $SWZ_{m0}$) enters the ON state and applies the ground potential to the column electrode $Z_i$. That is, when a resonance pulse supply voltage is applied to the column electrode $Z_i$, a high-voltage pixel data pulse is generated and supplied to the column electrode $Z_i$, whereas, when the ground potential is applied to the column electrode $Z_i$, a low-voltage pixel data pulse is generated and supplied to the column electrode $Z_i$.

The operation of the power supply circuit 21 for generating this resonance pulse supply voltage will be described below.

Switching signals SW1 to SW3, which repeatedly set the corresponding switching elements S1 to S3 to the ON state in the order of the switching elements S1, S3, and then S2, are supplied to the switching elements S1 to S3 in order to operate the power supply circuit 21.

When only the switching element S1 enters the ON state in response to the switching signal SW1, the capacitor C1 is discharged and the discharge current thereof flows to the power supply line 2 via the coil L1 and diode D1. If, at this time, the switching element $SWZ_i$ of the pixel data pulse generation circuit 22 is in the ON state, the discharge current flows into the column electrode $Z_i$ of the PDP 10 via the switching element $SWZ_i$, the load capacitor $C_0$ that is parasitic on the column electrode $Z_i$ is charged, and an accumulation of electrical charge occurs within the load capacitor $C_0$. In the meantime, the potential of the power supply line 2 gradually rises because of the resonance action caused by the coil L1 and the load capacitor $C_0$. This increase of the voltage is the rising edge of the above-mentioned high-voltage pixel data pulse.

When the switching element S3 alone enters the ON state in response to the switching signal SW3, a power supply voltage Va generated by a DC power supply B1 is applied to the power supply line 2. The power supply voltage Va is the maximum voltage of the high-voltage pixel data pulse.

When the switching element S2 is alone turned on in response to the switching signal SW2, the load capacitor $C_0$ that is parasitic on the column electrode $Z_i$ of the PDP 10 is discharged. This discharge current flows into the capacitor C1 via the column electrode $Z_i$, the switching element $SWZ_i$, the power supply line 2, the coil L2, the diode D2, and the switching element S2, whereby the capacitor C1 is charged. That is, the electrical charge that has accumulated in the load capacitor $C_0$ of the PDP 10 is recovered by the capacitor C1 provided in the power supply circuit 21. The voltage of the power supply line 2 gradually drops in accordance with the time constant that is determined by the coil L2 and load capacitor $C_0$. This voltage drop is the trailing edge of the high-voltage pixel data pulse.

As a result of the above described series of operations, a resonance pulse supply voltage having gradual voltage variation in the rising and trailing edges is generated and supplied to the pixel data pulse generation circuit 22 via the power supply line 2. When the switching element $SWZ_i$ enters the ON state in accordance with the pixel data bit DB of logic level 1, the resonance pulse supply voltage itself is applied to the column electrode $Z_i$ as the high-voltage pixel data pulse.

Therefore, the column electrode driver circuit 20 recovers electrical charge that has accumulated in the PDP 10, which functions as a capacitive load, and uses the recovered electrical charge when the rising edge of the pixel data pulse is generated. This reduces electrical power consumption.

Of the pixel data pulse generation circuit 22 and power supply circuit 21 in the column electrode driver circuit 20, the pixel data pulse generation circuit 22 is constructed by means of a single IC chip. On the other hand, the power supply circuit 21 includes the switching elements S1 to S3, the capacitor C1, the diodes D1 and D2, and the coils L1 and L2, and each of these components needs a relatively large current. Thus, each of the components of the power supply circuit 21 is a discrete component. It is therefore necessary to place eight discrete components that correspond to the switching elements S1 to S3, the capacitor C1, the diodes D1 and D2, and the coils L1 and L2 near the IC chip of the pixel data pulse generation circuit 22. Accordingly, the electric power consumption and the mounting area of the components are large.

SUMMARY OF THE INVENTION

One object of the present invention is to provide a driver device for a capacitive light emitting element that permits miniaturization and reduced electrical power consumption.

According to one aspect of the present invention, there is provided an improved driver device for driving a plurality of capacitive light emitting elements by supplying a drive-data-dependent voltage to the respective capacitive light emitting elements. The driver device includes a semiconductor integrated device and an electrical charge recovery circuit. The semiconductor integrated device includes a plurality of output buffers. One output buffer is associated with one capacitive light emitting element. The output buffer applies either a predetermined high voltage or low voltage to the associated capacitive light emitting element in accordance with the drive data. The semiconductor integrated device also includes a plurality of power supply switching elements that supply a power supply voltage with the high voltage to the output buffers. The semiconductor integrated device also includes an external terminal that is commonly connected to each of the nodes between the power supply switching elements and output buffers. The electrical charge recovery circuit is connected to the external terminal to recover electrical charge, which is accumulated in the capacitive light emitting elements, via the external terminal. The electrical charge recovery circuit can feed the recovered electrical charge to the external terminal.

These and other objects, aspects and advantages of the present invention will become apparent to those skilled in the art from the following detailed description and appended claims when read and understood in conjunction with the attached drawings.

DETAILED DESCRIPTION OF THE INVENTION

Figure 1:
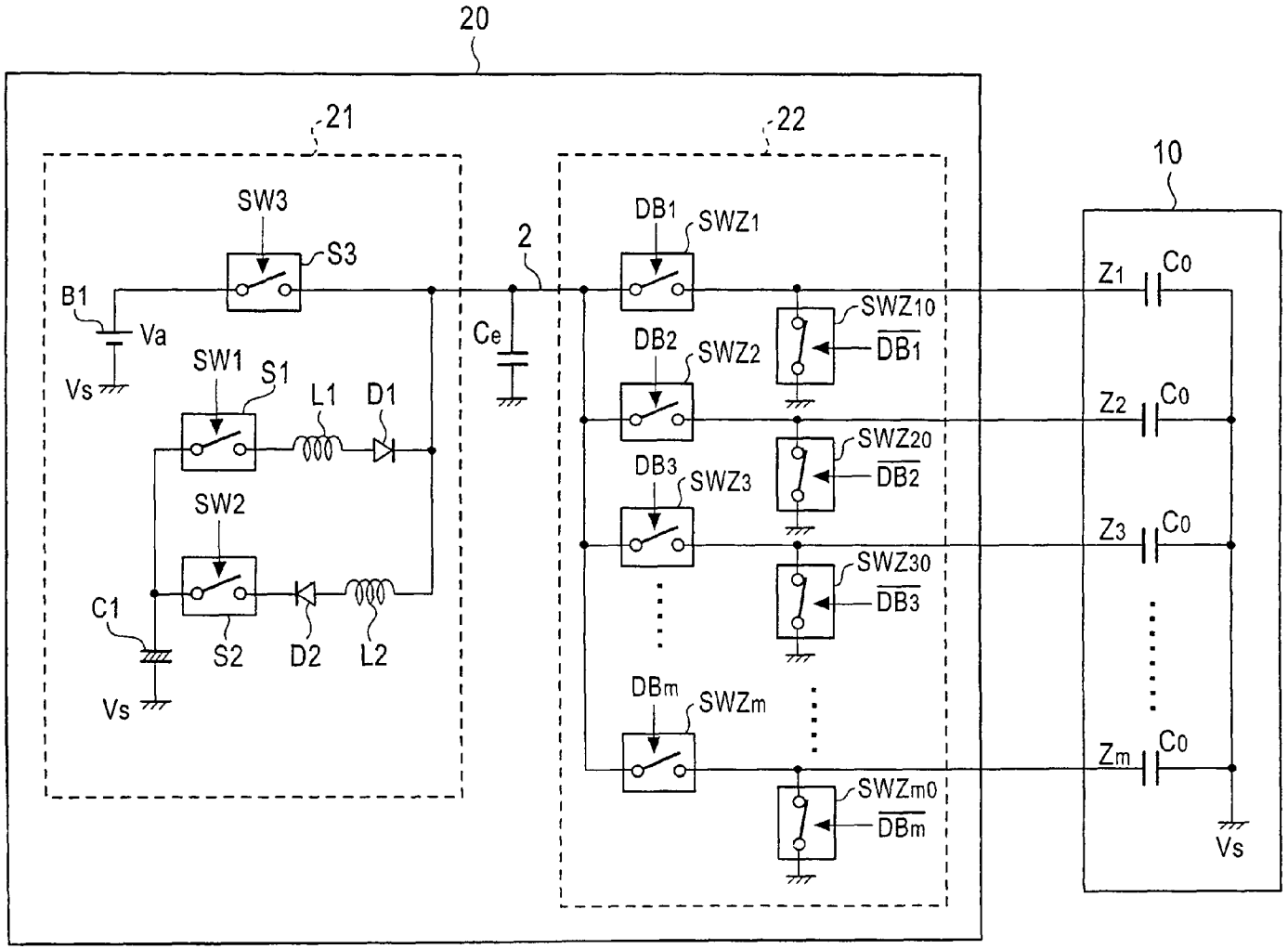
FIG. 1 PRIOR ART
FIG. 1 shows part of a driver device that causes a capacitive display panel to emit light by applying a variety of drive pulses to the capacitive display panel.
Figure 2:
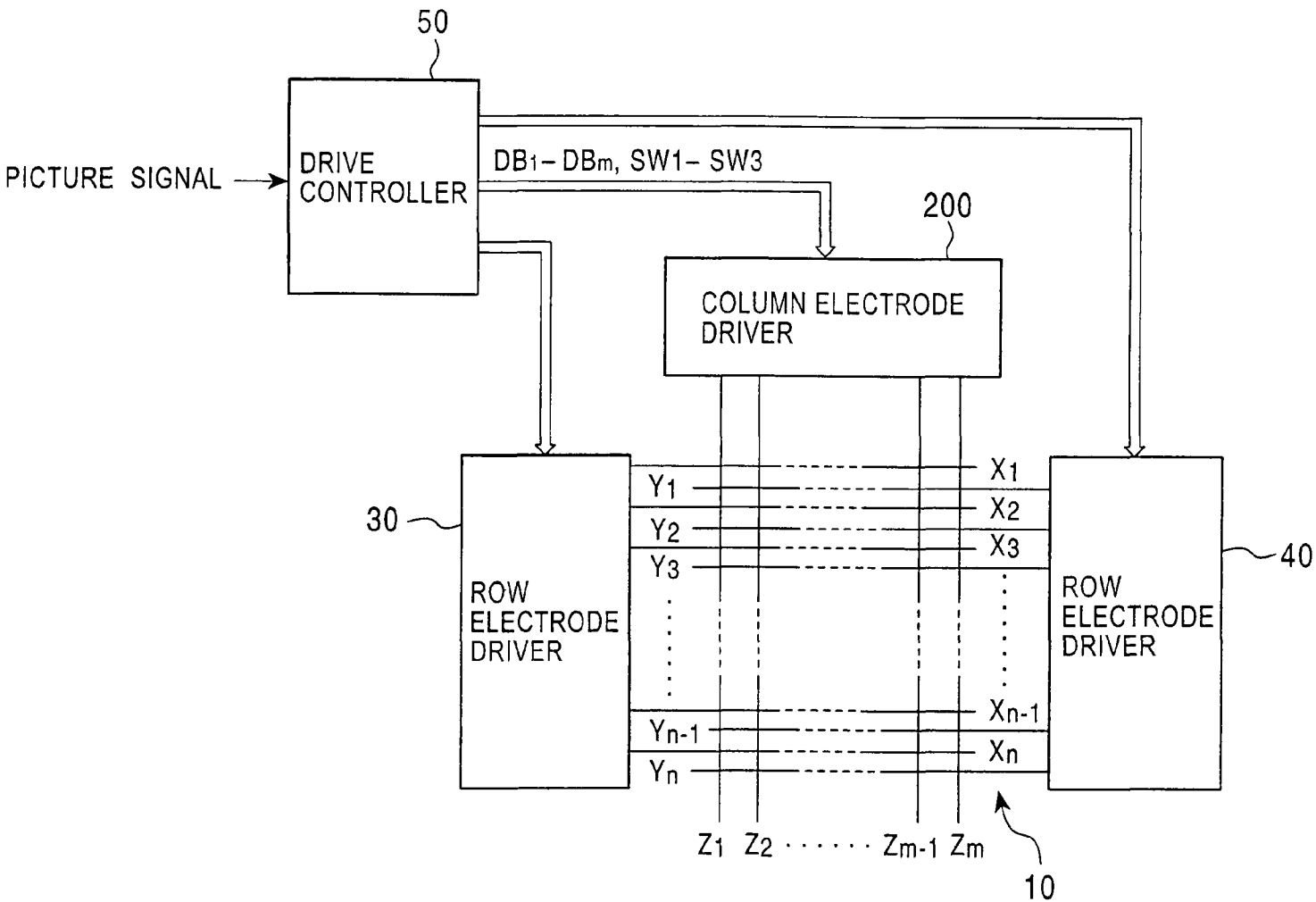
FIG. 2 shows a schematic constitution of a display device that adopts a PDP as a display panel having a plurality of capacitive light emitting elements.

Referring to FIG. 2, a display device that adopts a PDP as a display panel having capacitive light emitting elements will be described. Similar reference numerals are used in FIG. 2 and FIG. 1 to designate similar elements.

In FIG. 2, a PDP 10 includes a plurality of row electrodes $Y_1$ to $Y_n$ and $X_1$ to $X_n$, which are arranged to extend in the row (width) direction of the screen. The PDP 10 also includes a plurality of column electrodes $Z_1$ to $Z_m$, which are arranged to extend in the column (height) direction of the screen. Discharge spaces (not shown) are formed between the row electrodes and the column electrodes. The row electrodes are orthogonal to the column electrodes. Each pair of adjacent row electrodes $X_i$ and $Y_i$ define one display line of the screen. Discharge cells are formed at the points of intersection between the row electrode pairs and the column electrodes. The discharge cells serve as pixels.

A row electrode driver circuit 30 generates a sustaining pulse, which allows only discharge cells in which a wall charge remains to discharge, and applies the sustaining pulse to the row electrodes $X_1$ to $X_n$ of the PDP 10. Another row electrode driver circuit 40 generates a reset pulse, which initializes all the discharge cells, a scanning pulse, which sequentially selects a display line to write the pixel data to the selected display line, and a sustaining pulse, which causes only discharge cells having a wall charge to discharge, and applies these pulses to the row electrodes $Y_1$ to $Y_n$.

A drive control circuit 50 converts an inputted picture signal to 8-bit pixel data, for example, for each pixel and divides the pixel data into respective bit digits to obtain pixel data bits DB. The drive control circuit 50 supplies, for each of the display lines, pixel data bits $DB_1$ to $DB_m$ corresponding with the first to mth columns that belong to the display line concerned, to the column electrode driver circuit 200. Further, the drive control circuit 50 generates switching signals SW1 to SW3 for operating the column electrode driver circuit 200 and supplies these signals to the column electrode driver circuit 200.

The column electrode driver circuit 200 generates m pixel data pulses that correspond with the pixel data bits $DB_1$ to $DB_m$ and applies these pixel data pulses to the column electrodes $Z_1$ to $Z_m$ of the PDP 10. One display line's worth of discharge cells belonging to a row electrode Y to which a scanning pulse is applied by the row electrode driver circuit 40 are selectively discharged in accordance with the pixel data pulses. Depending on the occurrence of this selective discharge, each of the discharge cells is set to either a state where a wall charge is not present or a state where a wall charge remains. Each time a sustaining pulse is applied by the row electrode driver circuits 30 and 40, only the discharge cells in which electrical charge remains are discharged to emit light.

Figure 3:
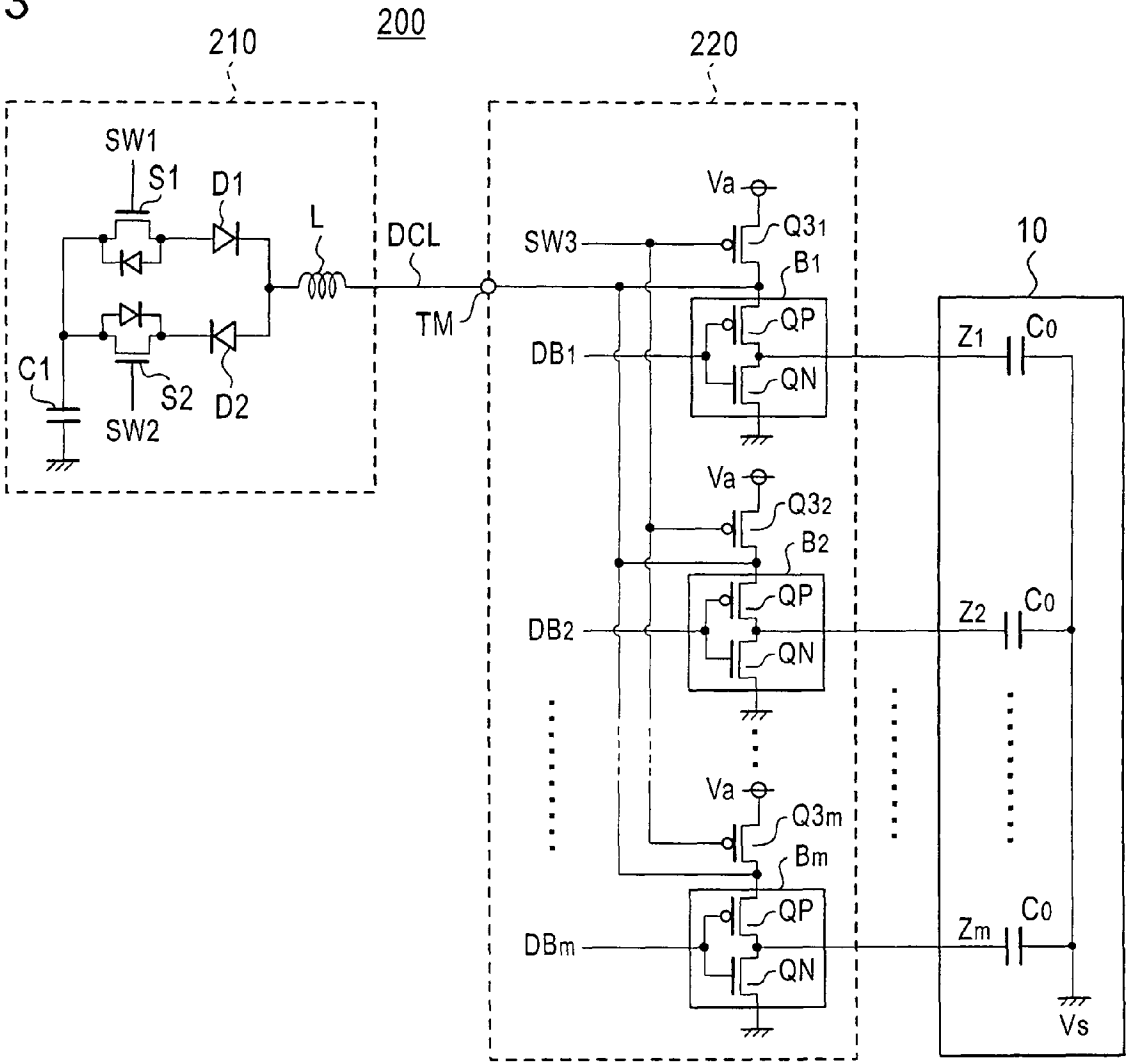
FIG. 3 shows the internal configuration of a column electrode driver circuit shown in FIG. 2.

FIG. 3 shows the internal constitution of the column electrode driver circuit 200. The column electrode driver circuit 200 is the driver device of the present invention.

As shown in FIG. 3, the column electrode driver circuit 200 includes an electrical charge recovery circuit 210 and a pixel data pulse generation circuit 220.

The electrical charge recovery circuit 210 includes a capacitor C1, switching elements S1 and S2, diodes D1 and D2, and a coil L. The coil L serves as an inductance.

A cathode electrode of the diode D1 and an anode electrode of the diode D2 are both connected to one end of the coil L, while a discharge/charge line DCL is connected to the other end of the coil L. One electrode of the capacitor C1 is grounded at the potential Vs of the PDP 10. The switching element S1 is controlled to be ON/OFF (turned on and off) in accordance with the switching signal SW1 that is supplied by the drive control circuit 50. When the switching element S1 enters the ON state, the capacitor C1 is discharged and a voltage generated at the other electrode of the capacitor C1 is applied to the discharge/charge line DCL via the diode D1 and coil L. The switching element S2 is controlled to be ON/OFF in accordance with the switching signal SW2 that is supplied by the drive control circuit 50. When the switching element S2 enters the ON state, the voltage of the discharge/charge line DCL is applied to the other electrode of the capacitor C1 via the coil L and diode D2, whereby the capacitor C1 is charged. That is, the current path including the switching element S1 and diode D1 becomes the discharge current path for the capacitor C1, and the current path including the switching element S2 and diode D2 becomes the charge current path for the capacitor C1.

The pixel data pulse generation circuit 220 includes m complementary buffers $B_1$ to $B_m$ that correspond with the column electrodes $Z_1$ to $Z_m$ of the PDP 10 and m p-channel-type MOS (Metal Oxide Semiconductor) transistors $Q3_1$ to $Q3_m$ (hereinafter referred to simply as 'transistors $Q3_1$ to $Q3_m$') that correspond with the m complementary buffers $B_1$ to $B_m$.

Each of the transistors $Q3_1$ to $Q3_m$ enters the ON state only when the switching signal SW3 of logic level 0 is supplied by the drive control circuit 50. When turned on, each transistor supplies the DC power supply voltage Va to the corresponding complementary buffer $B_i$. Each of the complementary buffers $B_1$ to $B_m$ generates a pixel data pulse that has a voltage dependent on the logic level of the corresponding pixel data bit $DB_i$ supplied by the drive control circuit 50, and applies the pixel data pulse to the corresponding column electrode $Z_i$ ($Z_1$ to $Z_m$) of the PDP 10.

Each complementary buffers $B_i$ includes a p-channel-type MOS transistor QP (hereinafter referred to simply as 'transistor QP') and an n-channel-type MOS transistor QN (hereinafter referred to simply as 'transistor QN'). As shown in FIG. 3, the gate electrodes of the transistors QP and QN are connected to each other in each complementary buffer $B_i$, and the drain electrodes of the transistors QP and QN are also connected to each other. The source electrode of the transistor QN of each complementary buffers $B_i$ is grounded at ground potential Vs, and the source electrode of the transistor QP of each complementary buffers $B_i$ is connected to the drain electrode of the transistor Q3 associated with the complementary buffer $B_i$ concerned. When a pixel data bit DB of logic level 1 is supplied to the gate electrode of each of the transistors QP and QN, only the transistor QN enters the ON state. When the transistor QN is turned on, a pixel data pulse with a O-volt voltage that corresponds with the ground potential Vs is applied to the column electrode $Z_i$. On the other hand, when a pixel data bit DB of logic level 0 is supplied to the gate electrode of each of the transistors QP and QN, only the transistor QP enters the ON state. While the switching signal SW3 of logic level 0 is being supplied, a pixel data pulse, the maximum voltage of which is the power supply voltage Va, is applied to the column electrode $Z_i$.

As shown in FIG. 3, the source electrodes of the transistors QP of the complementary buffers $B_1$ to $B_m$ are all connected to the discharge/charge terminal TM. The electrical charge recovery circuit 210 and pixel data pulse generation circuit 220 are electrically connected by the discharge/charge line DCL that is connected to the discharge/charge terminal TM.

Next, the actual operation of the electrical charge recovery circuit 210 and pixel data pulse generation circuit 220 will be described with reference to FIG. 4.

Figure 4:
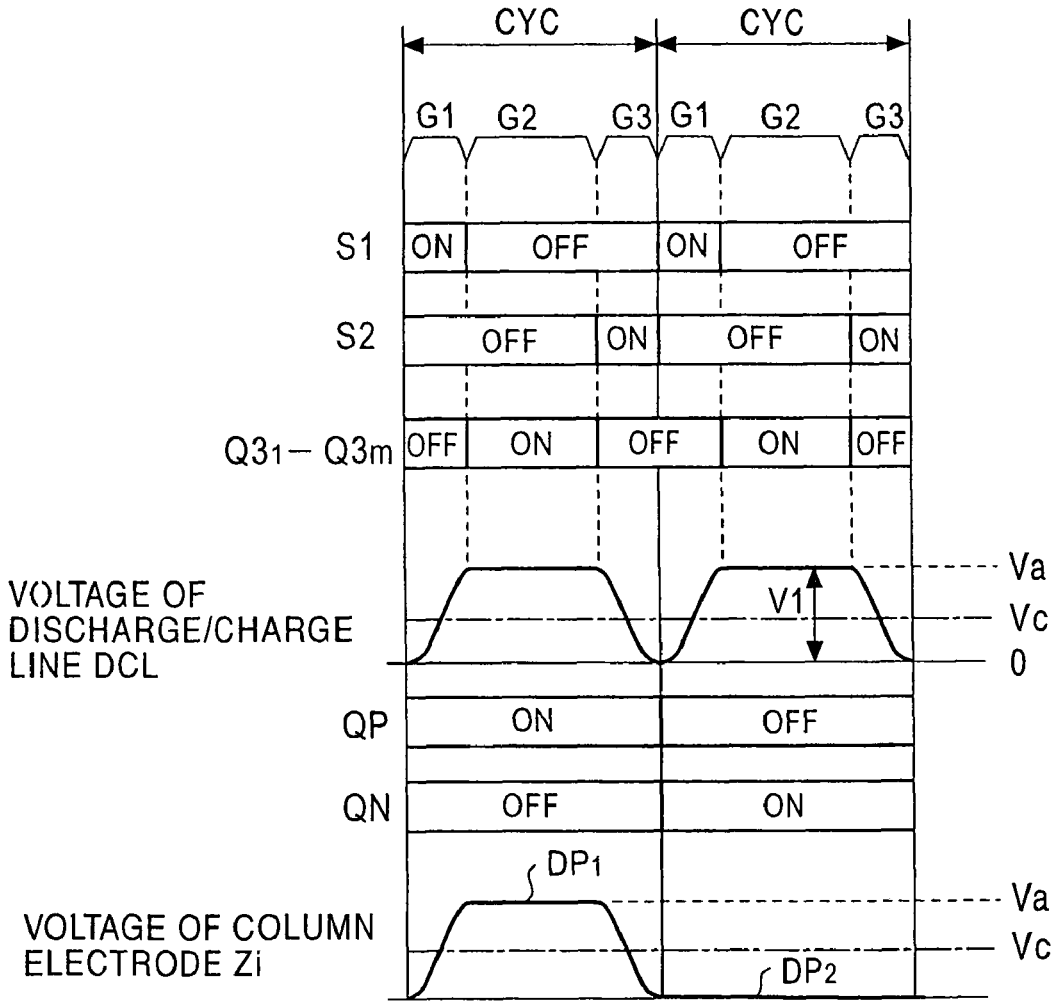
FIG. 4 illustrates drive sequences of switching elements and transistors shown in FIG. 3.

The drive control circuit 50 supplies the switching signals SW1 and SW2, which set the switching elements S1 and S2 respectively to the ON or OFF state in accordance with the sequence as shown in FIG. 4, to the electrical charge recovery circuit 210. The drive control circuit 50 also supplies the switching signal SW3, which sets each of the transistors $Q3_1$ to $Q3_m$ to the ON or OFF state in accordance with the sequence as shown in FIG. 4 (drive steps G1 to G3), to the pixel data pulse generation circuit 220.

First, in the drive step G1 shown in FIG. 4, only the switching element S1 enters the ON state in response to the switching signal SW1. Thereupon, the capacitor C1 is discharged and the discharge current thereof flows into the pixel data pulse generation circuit 220 via the diode D1, coil L, discharge/charge line DCL and discharge/charge terminal TM. If the transistor QP is in the ON state in accordance with the pixel data bit $DB_i$, the discharge current flows into the corresponding column electrode $Z_i$ of the PDP 10 via the transistor QP, and the load capacitor $C_0$ that is parasitic on the column electrode $Z_i$ is charged. Because of the resonance action of the coil L and load capacitor $C_0$, the voltage of the discharge/charge line DCL and column electrode Z gradually rises as shown in FIG. 4. The increase of this voltage is the leading edge of the pixel data pulse.

Next, in the drive step G2 shown in FIG. 4, each of the transistors $Q3_1$ to $Q3_m$ enters the ON state in accordance with the switching signal SW3. Thereupon, the DC power supply voltage Va is applied to the source electrode of the transistor QP of each of the complementary buffers $B_1$ to $B_m$ via the associated transistor $Q3_i$. When the transistor QP is set to the ON state in accordance with a pixel data bit $DB_i$, the power supply voltage Va is applied to the associated column electrodes $Z_i$ via the transistor QP. The load capacitor $C_0$ that is parasitic on each column electrode $Z_i$ is successively charged as a result of application of the power supply voltage Va. Consequently, the voltage of the discharge/charge line DCL and column electrode $Z_i$ is fixed at the power supply voltage Va, as shown in FIG. 4. The power supply voltage Va is the highest voltage value of the pixel data pulse.

In the drive step G3 shown in FIG. 4, only the switching element S2 enters the ON state in response to the switching signal SW2. Then, the load capacitor $C_0$ that is parasitic on each column electrode $Z_i$ of the PDP 10 is discharged and the discharge current thereof flows into the capacitor C1 via the column electrode $Z_i$, the transistor QP of the complementary buffer $B_i$, the discharge/charge terminal TM, the discharge/charge line DCL, the coil L, the diode D2, and the switching element S2, whereby the capacitor C1 is charged. That is, the electrical charge that has accumulated in each load capacitor $C_0$ of the PDP 10 is gradually recovered by the capacitor C1. The voltage of the discharge/charge line DCL and the voltage of the column electrode $Z_i$ gradually drop in accordance with the time constant that is determined by the coil L and load capacitor $C_0$, as shown in FIG. 4. This decrease of the voltage is the trailing edge of the pixel data pulse.

As a result of the above described sequence (drive steps G1 to G3), the resonance pulse supply voltage having a resonance amplitude $V_1$ of which maximum voltage is the power supply voltage Va as shown in FIG. 4 is generated on the discharge/charge line DCL. When the transistor QP enters the ON state in accordance with a pixel data bit $DB_i$ of logic level 0, a pixel data pulse $DP_1$ with the resonance pulse supply voltage is applied to the column electrode $Z_i$ of the PDP 10 as shown in FIG. 4. On the other hand, when the transistor QN enters the ON state in accordance with a pixel data bit $DB_i$ of logic level 1, a 0-volt pixel data pulse $DP_2$ is applied to the column electrode $Z_i$ of the PDP 10 as shown in FIG. 4.

In the pixel data pulse generation circuit 220 shown in FIG. 3, each of the complementary buffers $B_1$ to $B_m$ and the transistors $Q3_1$ to $Q3_m$ supplying the DC power supply voltage Va to the complementary buffers $B_1$ to $B_m$ are constructed by means of an IC with a CMOS (Complementary Metal Oxide Semiconductor) structure. A discharge/charge terminal TM is provided on the IC package in which the complementary buffers $B_1$ to $B_m$ and the switching elements $Q3_1$ to $Q3_m$ are provided. An electrical charge recovery circuit 210, which includes six discrete components (i.e., the capacitor C1, switching elements S1 and S2, diodes D1 and D2, and coil L), is connected to the discharge/charge terminal TM of the IC package.

That is, by adopting m transistors $Q3_1$ to $Q3_m$ as shown in FIG. 3 in place of the switching element S3 (FIG. 1) that supplies the power supply voltage Va (the maximum voltage of the pixel data pulse), the power supply voltage Va is supplied individually to each of the complementary buffers $B_1$ to $B_m$. As a result, the amount of current flowing to each transistor Q3 is 1/m (where m is the number of column electrodes) the amount of current flowing to the switching element S3 shown in FIG. 1. Accordingly, as mentioned earlier, the complementary buffers $B_1$ to $B_m$ and transistors $Q3_1$ to $Q3_m$ supplying the power supply voltage Va that decides the maximum voltage of the pixel data pulse can be integrated into one chip by means of an IC with a CMOS structure that consumes a relatively small amount of electrical power.

Therefore, in comparison with a conventional arrangement in which the power supply voltage Va (maximum voltage of the pixel data pulse) is supplied by means of a single discrete component such as the switching element S3 shown in FIG. 1, the number of externally connected discrete components is smaller and therefore the mounting area and amount of electrical power consumed can be reduced.

A switching element, which removes excess electrical charge accumulated in the load capacitor $C_0$ of the PDP 10, may be provided in the pixel data pulse generation circuit 220, and this switching element may be integrated with the transistors $Q3_1$ to $Q3_m$ and complementary buffers $B_1$ to $B_m$ into one chip IC. This modification will be described with reference to FIG. 5.

Figure 5:
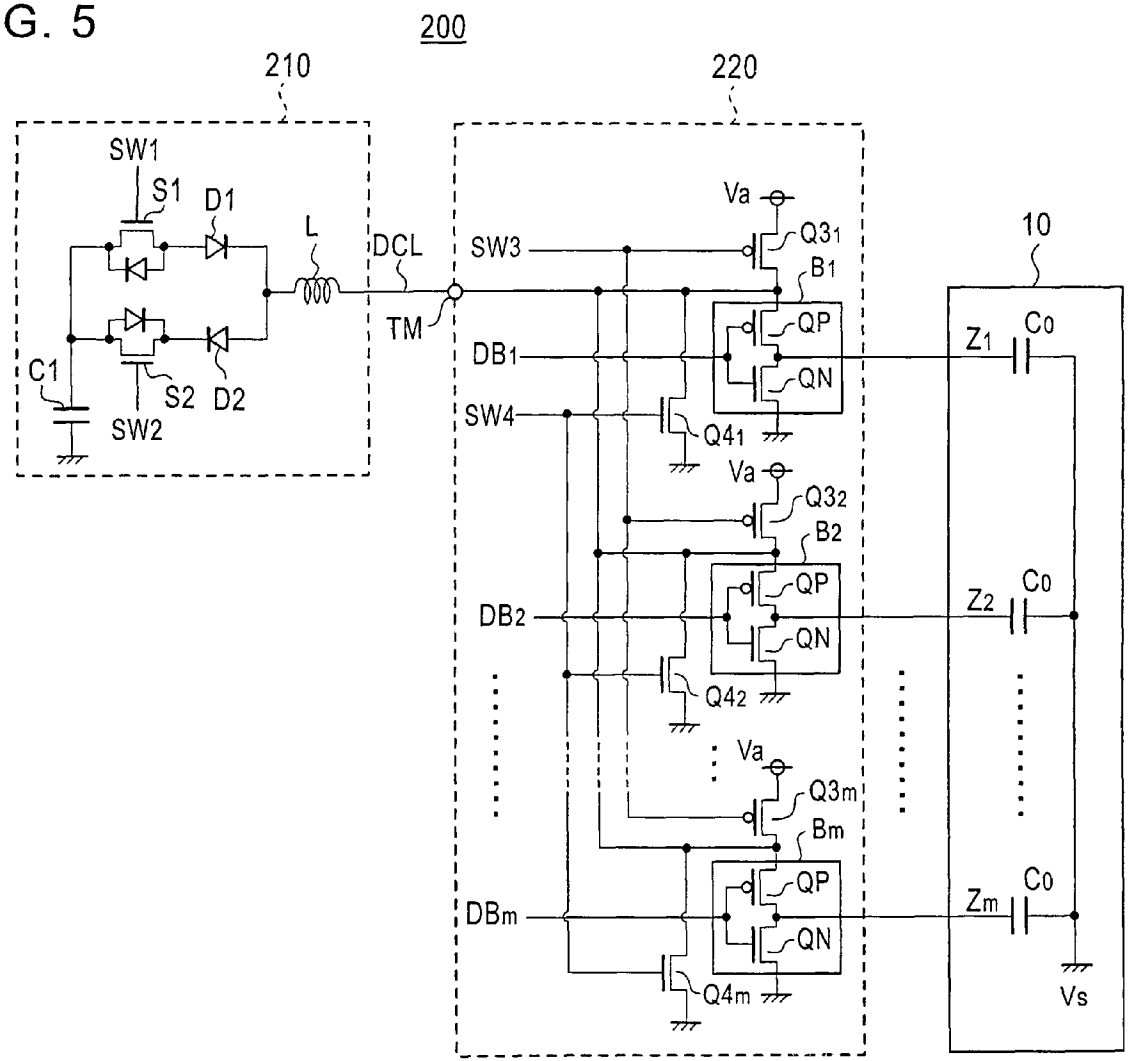
FIG. 5 shows a modification to a pixel data pulse generation circuit shown in FIG. 3.

FIG. 5 shows a modified pixel data pulse generation circuit 220. In this pixel data pulse generation circuit 220, n-channel MOS-type transistors $Q4_1$ to $Q4_m$ are provided in addition to the complementary buffers $B_1$ to $B_m$ and transistors $Q3_1$ to $Q3_m$ that are shown in FIG. 3. The drain electrode of each of the transistors $Q4_1$ to $Q4_m$ is connected to a node between the associated complementary buffer $B_i$ and transistor $Q3_i$. Each of the transistors $Q4_1$ to $Q4_m$ enters the ON state when a switching signal SW4 of logic level 1 is supplied by the drive control circuit 50. When the transistors Q4 are turned on, each of the nodes between the respective complementary buffers $B_1$ to $B_m$ and respective transistors $Q3_1$ to $Q3_m$ is grounded. Consequently, the excess electrical charge that has accumulated in the load capacitor $C_0$ of the PDP 10 is discharged via the transistor QP of the associated complementary buffer $B_i$ and the associated transistors $Q4_i$.

Figure 6:
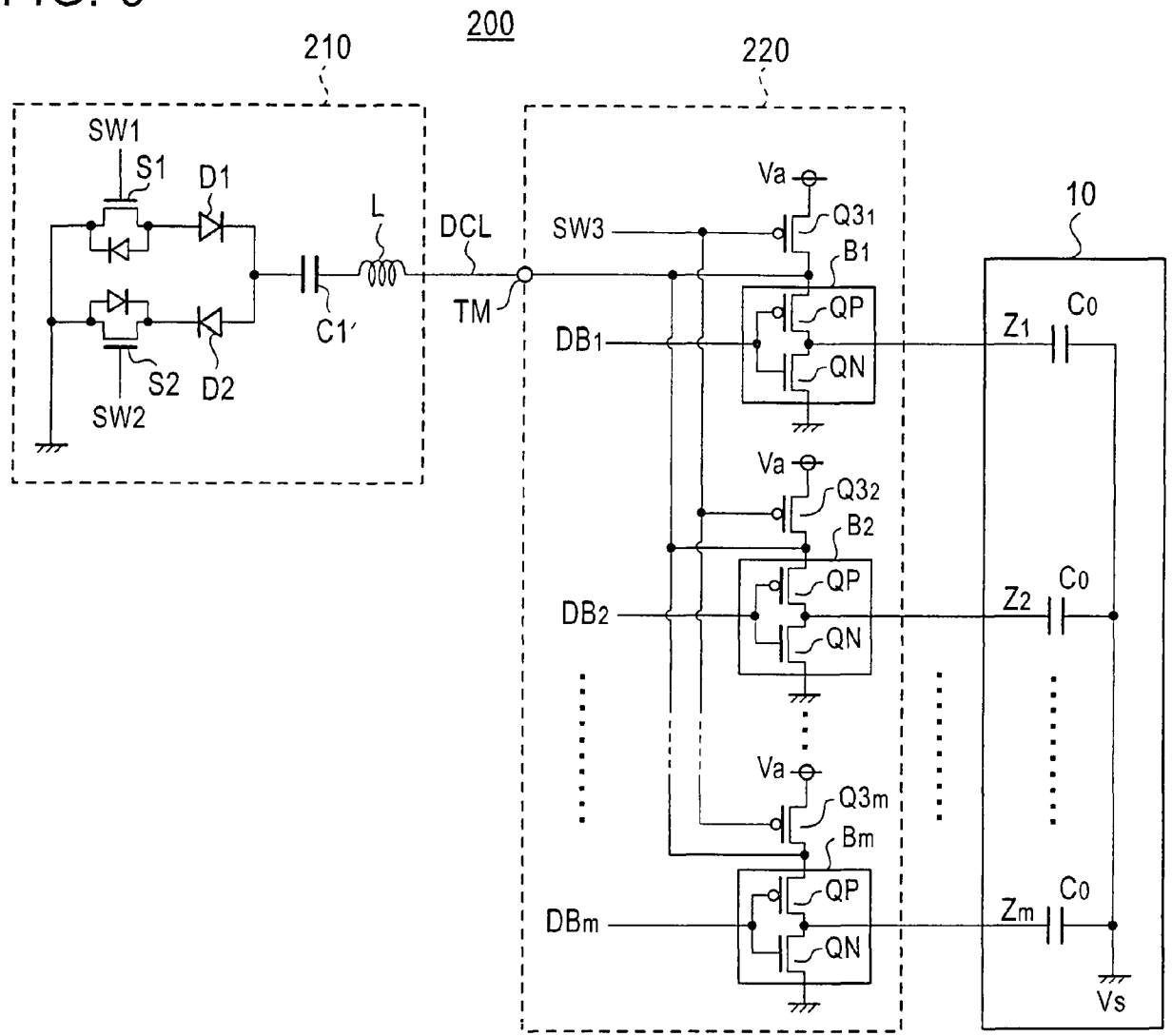
FIG. 6 shows a modification to an electrical charge recovery circuit shown in FIG. 3.

The circuit constitution shown in FIG. 3 for the electrical charge recovery circuit 210 may be modified to a circuit constitution as shown in FIG. 6.

In the electrical charge recovery circuit 210 shown in FIG. 6, one electrode terminal of each of the switching elements S1 and S2 is directly grounded. The other electrode terminal of the switching element S1 is connected to the anode electrode of the diode D1 and the other electrode terminal of the switching element S2 is connected to the cathode electrode of the diode D2. The cathode electrode of the diode D1 and the anode electrode of the diode D2 are both connected to one electrode of the capacitor C1, and one end of the coil L is connected to the other electrode of the capacitor C1. The other end of the coil L is connected to the discharge/charge line DCL. Similar to FIG. 3, a current path that includes the switching element S1 and diode D1 is the discharge current path for the capacitor C1, while a current path that includes the switching element S2 and diode D2 is the charge current path.

The switching element S1 or S2 of the electrical charge recovery circuit 210 shown in FIG. 6 may be located in the pixel data pulse generation circuit 220 and be integrated with the transistors $Q3_1$ to $Q3_m$ and complementary buffers $B_1$ to $B_m$ into one chip IC. This modification will be described with reference to FIG. 7.

Figure 7:
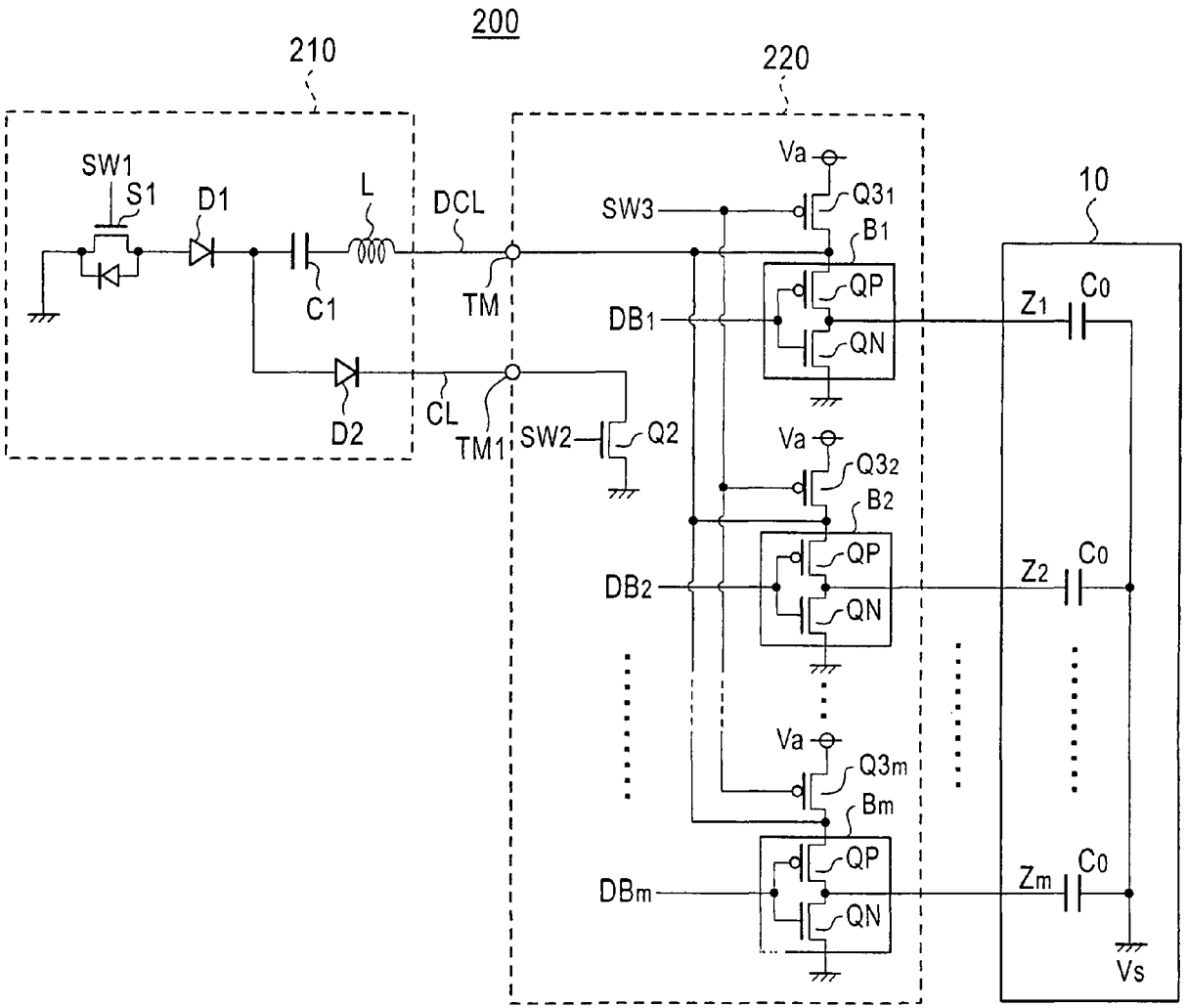
FIG. 7 shows another modification to the electrical charge recovery circuit and pixel data pulse generation circuit.

FIG. 7 shows a modified electrical charge recovery circuit 210 and a modified pixel data pulse generation circuit 220.

In the electrical charge recovery circuit 210 shown in FIG. 7, one electrode terminal of the switching element S1 is grounded, while the other electrode terminal is connected to the anode electrode of the diode D1. The cathode electrode of the diode D1 and the anode electrode of the diode D2 are both connected to one electrode of the capacitor C1. One end of the coil L is connected to the other electrode of the capacitor C1. The other end of the coil L is connected to the discharge/charge terminal TM of the pixel data pulse generation circuit 220 via the discharge/charge line DCL. The cathode electrode of the diode D2 is connected to a discharge/charge terminal TM1 of the pixel data pulse generation circuit 220 via a charge line CL.

The pixel data pulse generation circuit 220 shown in FIG. 7 includes the transistors $Q3_1$ to $Q3_m$ and complementary buffers $B_1$ to $B_m$ shown in FIG. 3 and an n-channel-type MOS transistor Q2. The source electrode of the transistor Q2 is connected to the discharge/charge terminal TM1 and the drain electrode of the transistor Q2 is grounded. The transistor Q2 performs the same operation as the switching element S2 shown in FIG. 3. That is, in the drive step G3 shown in FIG. 4, the transistor Q2 enters the ON state in response to the switching signal SW2 supplied from the drive control circuit 50. When the transistor Q2 is turned on, the electrical charge that has accumulated in the load capacitor $C_0$ of the PDP 10 is discharged and the current accompanying this discharge flows into the capacitor C1 via the transistor QP of each of the complementary buffers $B_1$ to $B_m$, the discharge/charge line DCL, and coil L, whereby the capacitor C1 is charged. That is, recovery of electrical charge is effected by the capacitor C1.

Therefore, in the circuit constitution shown in FIG. 7, the current path including the switching element S1 and diode D1 becomes the discharge current path for the capacitor C1, while the current path including the diode D2, the charge line CL and the transistor Q2 of the pixel data pulse generation circuit 220 becomes the charge current path.

According to the circuit constitution shown in FIG. 7, the complementary buffers $B_1$ to $B_m$, the transistors $Q3_1$ to $Q3_m$, and the transistor Q2 that is part of the charge current path are integrated into one chip IC.

Figure 8:
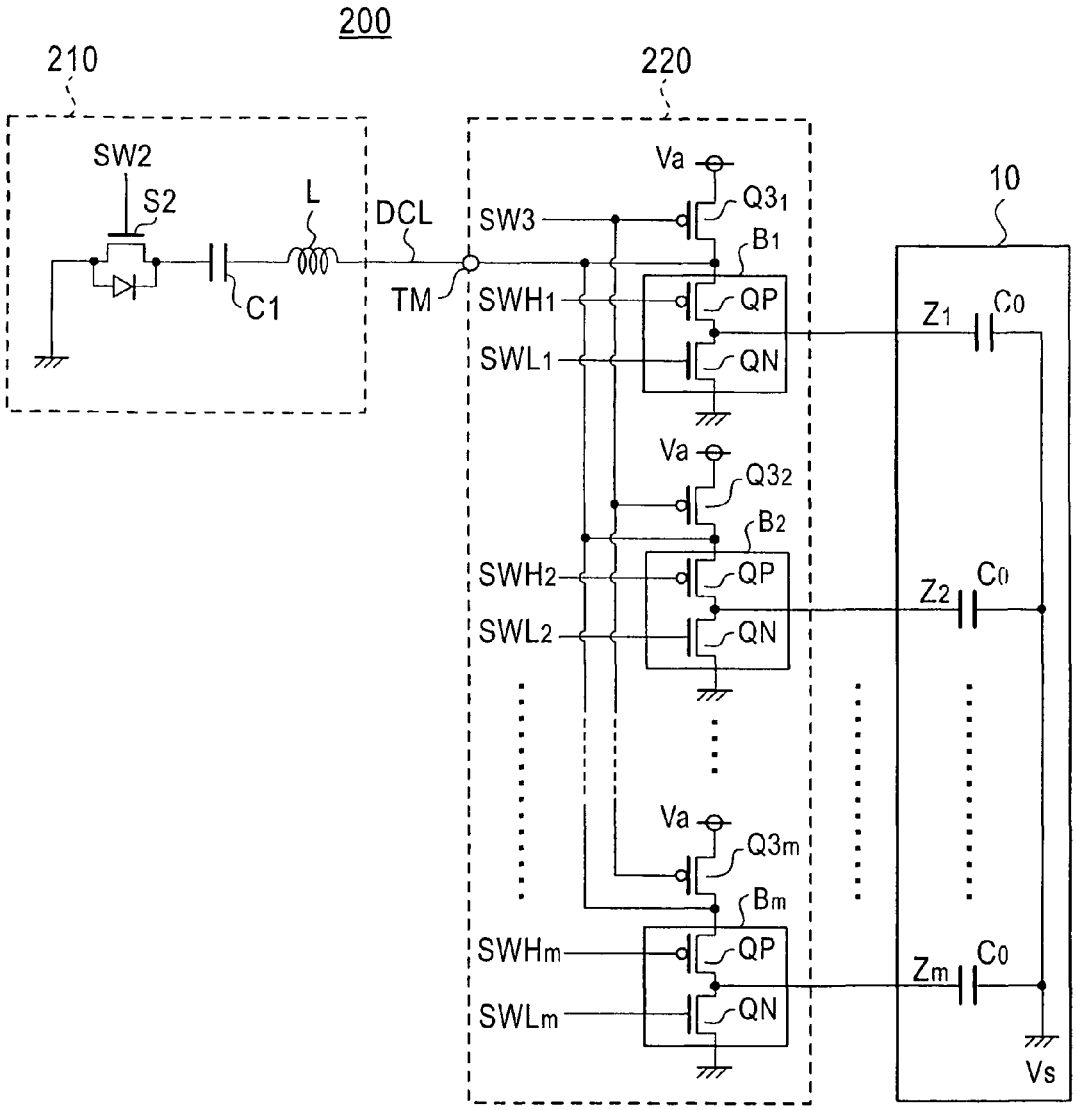
FIG. 8 shows still another modification to the electrical charge recovery circuit and pixel data pulse generation circuit.

A modification can be made to the electrical charge recovery circuit 210 shown in FIG. 6. This modification will be described with reference to FIG. 8. In FIG. 8, the switching element S1 and diodes D1 and D2 are removed, when compared with FIG. 6. The transistor QP of each complementary buffer $B_i$ ($B_1$ to $B_m$) in the pixel data pulse generation circuit 220 is on-off controlled (turned on and off) in response to the switching signal $SWH_i$ ($SWH_1$ to $SWH_m$) corresponding with the pixel data bit $DB_i$ ($DB_1$ to $DB_m$). Likewise, the transistor QN of each complementary buffer $B_i$ is controlled to on or off in accordance with the switching signal $SWL_i$ corresponding with the pixel data bit $DB_i$.

Figure 9:
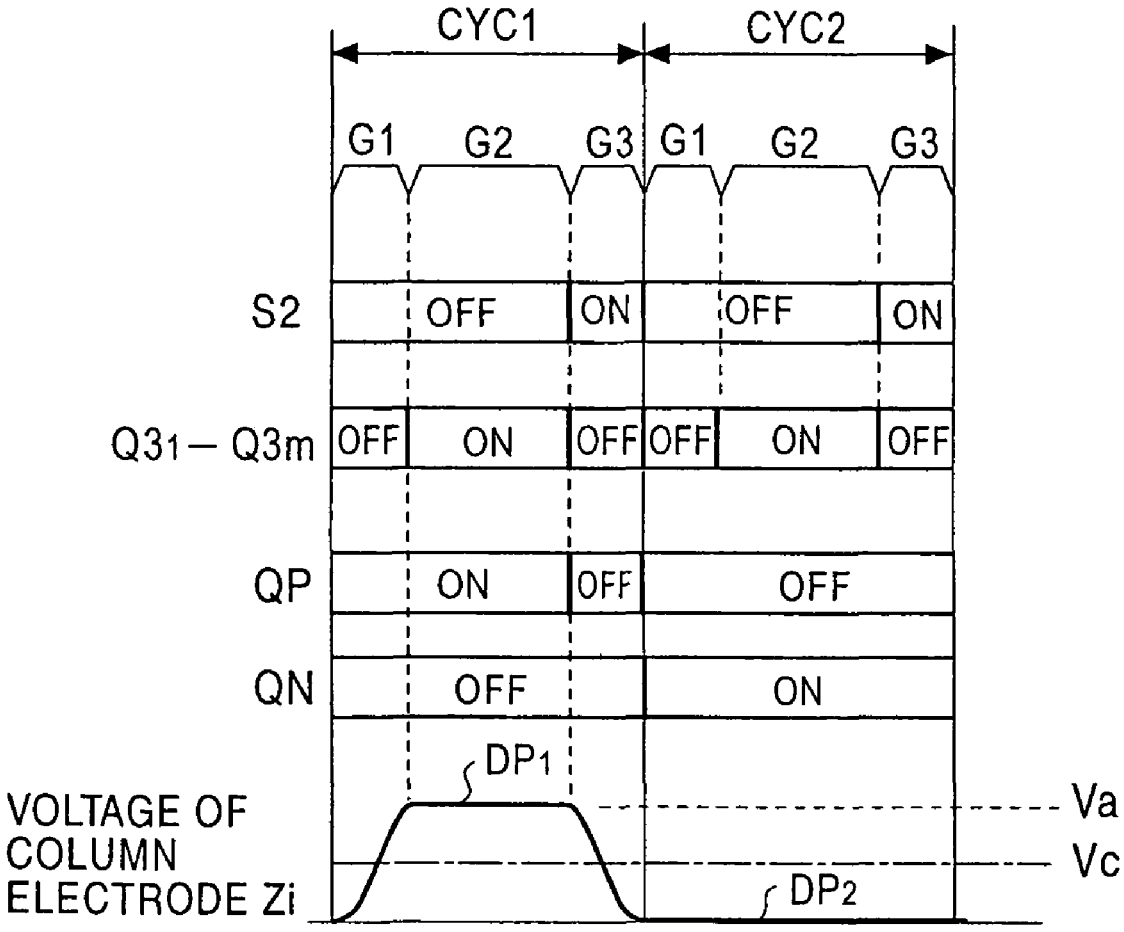
FIG. 9 shows the operation of the electrical charge recovery circuit and pixel data pulse generation circuit shown in FIG. 8.

FIG. 9 shows an example of the operation of the electrical charge recovery circuit 210 and pixel data pulse generation circuit 220 shown in FIG. 8.

The drive control circuit 50 first sets the switching element S2 and each of the transistors $Q3_1$ to $Q3_m$ to the OFF state (drive step G1). Next, the drive control circuit 50 sets the switching element S2 to the OFF state and each of the transistors $Q3_1$ to $Q3_m$ to the ON state (drive step G2). The drive control circuit 50 then sets the switching element S2 to the ON state and each of the transistors $Q3_1$ to $Q3_m$ to the OFF state (drive step G3). The drive control circuit 50 repeatedly executes this switching sequence CYC (i.e., the drive steps G1 to G3) in accordance with each of the bits in the pixel data bit train DB. When the pixel data bit $DB_1$ for the column electrode $Z_1$ is logic level 1, for example, the drive control circuit 50 sends the switching signal $SWH_1$ to the complementary buffer $B_1$. This switching signal $SWH_1$ sets the transistor QP to the ON state over the periods of execution of the drive steps G1 and G2 and sets the transistor QP to the OFF state over the period of execution of drive step G3 as shown in the sequence CYC1 in FIG. 9. Thus, during the period of execution of the drive step G1, the capacitor C1 is discharged and the discharge current thereof flows into the column electrode $Z_1$ of the PDP 10 via the coil L, the discharge/charge line DCL, and the transistor QP of the complementary buffer $B_1$. Accordingly, the load capacitor $C_0$ that is parasitic on the column electrode $Z_1$ is charged. In the meantime, as a result of the resonance action of the coil L and load capacitor $C_0$, the voltage of the column electrode $Z_1$ gradually rises. This increase of the voltage is the leading edge of the pixel data pulse. During the period of execution of the drive step G2, the transistor $Q3_1$ enters the ON state, and therefore the power supply voltage Va is applied to the column electrode $Z_1$ via the transistor $Q3_1$ and the transistor QP of the complementary buffer $B_1$. The power supply voltage Va is the highest voltage value of the pixel data pulse. During the period of execution of the drive step G3, the switching element S2 is switched to the ON state and the transistor QP of the complementary buffer $B_1$ and the transistor $Q3_1$ are switched to the OFF state. Accordingly, the load capacitor $C_0$ of the PDP 10 is discharged, and the discharge current that accompanies this discharge is sent to the complementary buffer $B_1$ via the column electrode $Z_1$. The transistor QP of the complementary buffer $B_1$ is in the OFF state, but the discharge current flows into the capacitor C1 via the parasitic diode that is parasitic on the transistor QP, the discharge/charge line DCL and the coil L, whereby the capacitor C1 is charged. That is, the electrical charge that has accumulated in the load capacitor $C_0$ of the PDP 10 is recovered by the capacitor C1. The voltage of the column electrode $Z_1$ gradually drops as shown in FIG. 9 in accordance with a time constant that is determined by the coil L and the load capacitor $C_0$. This decrease of the voltage is the trailing edge of the pixel data pulse.

As described above, in FIG. 8, the transistors QP of the complementary buffers B perform the same function as the switching element S1 of the electrical charge recovery circuit 210 in FIG. 3 and serve as switches to control the discharge paths of the capacitor C1.

Figure 10:
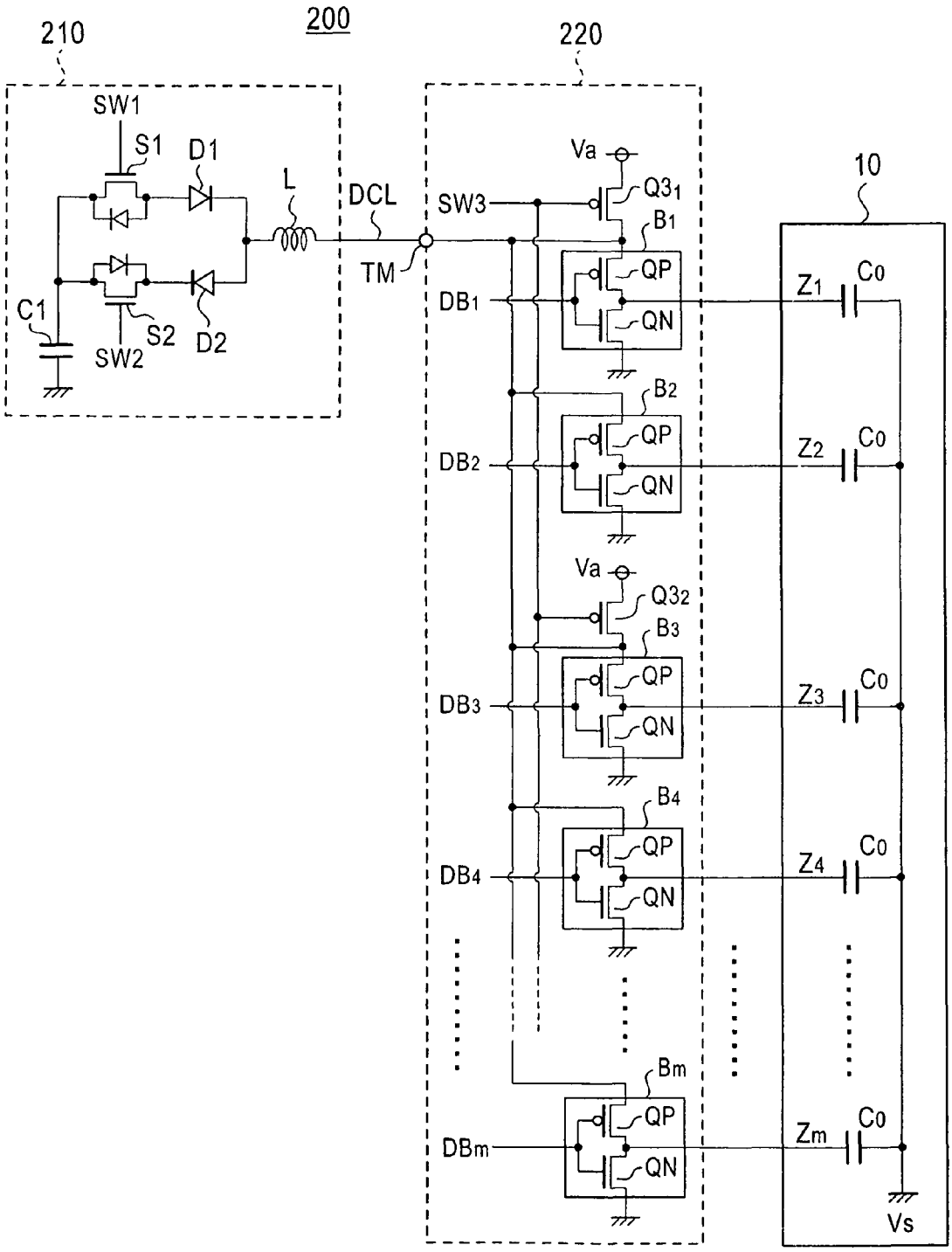
FIG. 10 shows another modification to the pixel data pulse generation circuit.

Although the transistor $Q3_i$ for supplying the DC power supply voltage Va is provided for each of the complementary buffers $B_1$ to $B_m$ in the illustrated embodiments, there is not necessarily a need to provide one transistor Q3 for one complementary buffer B. For example, as shown in FIG. 10, one transistor Q3 may be provided for every two complementary buffers B. Alternatively, one transistor Q3 may be provided for every three (or more) complementary buffers B. That is, one transistor Q3, which supplies a DC power supply voltage Va, may be provided for every K (where K is a natural number) complementary buffers B. In other words, the number of transistors Q3 may be determined (optimized) in accordance with the DC supply capacity.

The complementary buffer B is employed as an output buffer that applies a pixel data pulse to the associated column electrode Z in the above described embodiments. It should be noted that the transistors QP and QN provided in the complementary buffer B may be each constructed by an n-channel-type MOS transistor.

The switching element S2 in the electrical charge recovery circuit 210 in FIG. 8 may be integrated in an integrated circuit together with the pixel data pulse generation circuit 220 in the same manner as the transistor Q2 in FIG. 7.

This application is based on Japanese Patent Application No. 2003-362834 filed on Oct. 23, 2003 and the entire disclosure thereof is incorporated herein by reference.

What is claimed is:

1. A driver device for driving a plurality of capacitive light emitting elements by supplying a drive-data-dependent voltage to each of the plurality of capacitive light emitting elements, the driver device comprising:

a pixel data pulse generating circuit including a plurality of output buffers associated with the plurality of capacitive light emitting elements respectively, for applying either a predetermined high voltage or low voltage to the respective capacitive light emitting elements in accordance with the drive data, a plurality of power supply switching elements connected with the plurality of output buffers respectively for supplying a power supply voltage with the predetermined high voltage to the associated output buffers respectively, and an external terminal that is commonly connected to each of nodes between the power supply switching elements and the output buffers; and a resonance circuit connected to the external terminal for recovering electrical charge, which has accumulated in the capacitive light emitting elements, via the external terminal and for feeding the recovered electrical charge to the external terminal, wherein the resonance circuit includes a capacitor for recovering the electrical charge accumulated in the capacitive light emitting elements, a first switching element for feeding a first current, which corresponds with the recovered electrical charge, to the external terminal, and a second switching element for accepting a second current, which corresponds with the electrical charge accumulated in the capacitive light emitting elements, via the external terminal and supplying the second current to the capacitor, wherein the second switching element grounds one electrode of the capacitor when the second switching element is in an on state, and wherein when the second switching element is turned on and one electrode of the recovery capacitor is grounded, an accumulated electric charge is introduced to the recovery capacitor, the accumulated electric charge being the electric charge accumulated in the light emitting elements, the power supply switching elements are located in the pixel data pulse generating circuit, each of the plurality of power supply switching elements is directly connected to each of the plurality of output buffers respectively wherein the number of power supply switching elements is the same as the number of output buffers and the output buffers are located in the pixel data pulse generating circuit.

2. The driver device according to claim 1, wherein each of the power supply switching elements is connected individually to each of the output buffers.

3. The driver device according to claim 1, wherein each of the power supply switching elements is connected to each K (where K is an integer greater than one) said output buffers.

4. The driver device according to claim 1, further comprising a drive control circuit for repeatedly setting the first switching element, the power supply switching element and then the second switching element to an ON state.

5. The driver device according to claim 1, further comprising a plurality of ground switching elements for grounding each of nodes between the power supply switching elements and the output buffers, the plurality of ground switching elements being located in the semiconductor integrated device.

6. The driver device according to claim 1, wherein the first switching element grounds one electrode of the capacitor when the first switching element is in an on state.

7. The driver device according to claim 1, wherein the resonance circuit includes a capacitor for recovering the electrical charge accumulated in the capacitive light emitting elements, and the driver device further includes a first switching element for feeding a first current which corresponds with the recovered electrical charge to the capacitive light emitting elements and a second switching element for supplying a second current which corresponds with the electrical charge accumulated in the capacitive light emitting elements to the capacitor, and either the first switching element or the second switching element is located in the semiconductor integrated device.

8. The driver device according to claim 1, wherein the capacitive light emitting elements are column electrodes of a plasma display.

9. The driver device according to claim 1, wherein the output buffer is a complementary buffer that includes a p-channel-type MOS transistor and an n-channel-type MOS transistor.

10. An apparatus for driving a plurality of capacitive light emitting elements by supplying a drive-data-dependent voltage to each of the plurality of capacitive light emitting elements, the apparatus comprising:

a pixel data pulse generating circuit including a plurality of first means associated with the plurality of capacitive light emitting elements respectively, for applying either a predetermined high voltage or low voltage to the respective capacitive light emitting elements in accordance with the drive data, a plurality of second means connected with the plurality of first means respectively for supplying a power supply voltage with the predetermined high voltage to the associated plurality of first means respectively, and third means that is commonly connected to each of nodes between the plurality of first means and the plurality of second means; and fourth means connected to the third means for recovering electrical charge, which has accumulated in the capacitive light emitting elements, via the third means and for feeding the recovered electrical charge to the third means, wherein the fourth means includes fifth means for recovering the electrical charge accumulated in the capacitive light emitting elements, sixth means for feeding a first current, which corresponds with the recovered electrical charge, to the third means, and seventh means for accepting a second current, which corresponds with the electrical charge accumulated in the capacitive light emitting elements, via the third means and supplying the second current to the fifth means, wherein the fifth means has two electrodes, and the seventh means grounds one electrode of the fifth means when the seventh means is in an on state, and wherein when the seventh means is turned on and one electrode of the fifth means is grounded, an accumulated electric charge is introduced to the fifth means, the accumulated electric charge being the electric charge accumulated in the light emitting elements, the plurality of second means are located in the pixel data pulse generating circuit, and each of the plurality of second means is directly connected to each the plurality of first means respectively wherein the number of the plurality of second means is the same as the number of the plurality of first means, and the plurality of first means are located in the pixel data pulse generating circuit.

11. The apparatus according to claim 10, wherein each of the second means is connected individually to each of the first means.

12. The apparatus according to claim 10, wherein each of the second means is connected to each K (where K is an integer greater than one) said first means.

13. The apparatus according to claim 10, further comprising eight means for repeatedly setting the sixth means, the second means and then the seventh means to an ON state.

14. The apparatus according to claim 10, further comprising a plurality of ninth means for grounding each of nodes between the first means and the second means, the plurality of ninth means being located in the integrated device.

15. The apparatus according to claim 10, wherein the fifth means has two electrodes, and the sixth means grounds one electrode of the fifth means when the sixth means is in an on state.

16. The apparatus according to claim 10, wherein the fourth means includes tenth means for recovering the electrical charge accumulated in the capacitive light emitting elements, and the apparatus further includes eleventh means for feeding a first current which corresponds with the recovered electrical charge to the capacitive light emitting elements and twelfth means for supplying a second current which corresponds with the electrical charge accumulated in the capacitive light emitting elements to the tenth means, and either the eleventh means or the twelfth means is located in the integrated device.

* * * * *